United States Patent [19]

Quist et al.

[11] Patent Number: 4,603,029

[45] Date of Patent: Jul. 29, 1986

[54] ALUMINUM-LITHIUM ALLOY

[75] Inventors: William E. Quist, Redmond; R. Eugene Curtis, Issaquah; G. Hari Narayanan, Seattle, all of Wash.

[73] Assignee: The Boeing Company, Seattle, Wash.

[21] Appl. No.: 711,348

[22] Filed: Mar. 13, 1985

Related U.S. Application Data

[63] Continuation-in-part of Ser. No. 567,097, Dec. 30, 1983, abandoned.

[51] Int. Cl.[4] ..... C22C 21/08

[52] U.S. Cl. ..... 420/535; 420/537; 420/538; 420/544; 148/133; 148/159; 148/417; 148/439

[58] Field of Search ..... 420/535, 537, 538, 544; 148/13, 133, 142, 143, 159, 417

[56] References Cited

U.S. PATENT DOCUMENTS

| | | | |
|---|---|---|---|
| 3,343,948 | 9/1967 | Raclot | 420/535 |
| 3,876,474 | 4/1975 | Watts et al. | 420/535 |
| 4,067,733 | 1/1978 | Urdea | 420/535 |
| 4,094,705 | 6/1978 | Sperry et al. | 420/544 |

FOREIGN PATENT DOCUMENTS 2115836A 9/1983 United Kingdom .

OTHER PUBLICATIONS

C. J. Peel, B. Evans, C. A. Baker, D. A. Bennett, P. J. Gregson and H. M. Flower, "The Development and Application of Improved Aluminum-Lithium Alloys," Apr., 1983.

R. E. Lewis, I. G. Palmer, J. C. Ekvall, I. F. Sakata and W. E. Quist, "Aerospace Structural Applications of Rapidly Solidified Aluminum-Lithium Alloys," Apr., 1983.

*Primary Examiner*—Stephen J. Lechert, Jr.

*Attorney, Agent, or Firm*—Christensen, O'Connor, Johnson & Kindness

[57] ABSTRACT

An aluminum-lithium alloy exhibiting good fracture toughness and relatively high strength has a nominal composition of 2.5 percent lithium, 0.6 percent magnesium, 1.8 percent copper, 0.12 percent zirconium with the balance being aluminum and trace elements.

11 Claims, No Drawings

ALUMINUM-LITHIUM ALLOY

This application is a continuation-in-part of applicants' copending application Ser. No. 567,097, filed Dec. 30, 1983, now abandoned.

BACKGROUND OF THE INVENTION

The present invention relates to aluminum-lithium alloys and more particularly to an aluminum-lithium alloy composition with high fracture toughness and high strength.

It has been estimated that current large commercial transport aircraft may be able to save from 15 to 20 gallons of fuel per year for every pound of weight that can be saved when building the aircraft. Over the projected 20 year life of an airplane, this savings amounts to 300 to 400 gallons of fuel. At current fuel costs, a significant investment to reduce the structural weight of the aircraft can be made to improve overall economic efficiency of the aircraft.

The need for improved performance in aircraft of various types can be satisfied by the use of improved engines, improved airframe design, and improved or new structural materials in the aircraft. The development of new and improved structural materials has recently received increased attention and is expected to yield significant gains in performance.

Materials have always played an important role in dictating aircraft structural concepts. In the early part of this century, aircraft structure was composed of wood, primarily spruce, and fabric. Because shortages of spruce developed in the early part of the century, lightweight metal alloys began to be used as aircraft structural materials. At about the same time, improvements in design brought about the development of the all metal cantilevered wing. It was not until the 1930's, however, that the metal skin wing design became standard and firmly established metals, primarily aluminum alloys, as the major airframe structural material. Since that time, aircraft structural materials have remained remarkably consistent with aluminum structural materials being used primarily in the wing, body and empennage, and with steel comprising the material for the landing gear and certain other speciality applications requiring very high strength materials.

Several new materials are currently being developed for incorporation into aircraft structure. These include new metallic materials, metal matrix composites and resin matrix composites. It is believed that improved aluminum alloys and carbon fiber composites will dominate aircraft structural materials in the coming decades. While composites will be used in increased percentages as aircraft structural materials, new lightweight aluminum alloys, and especially aluminum-lithium alloys, show great promise for extending the use of aluminum alloys in aerospace structures.

Heretofore, aluminum-lithium alloys have been used only sparsely in aircraft structure. The relatively low use has been caused by casting difficulties associated with aluminum-lithium alloys and by their relatively low fracture toughness compared to other more conventional aluminum alloys. Aluminum-lithium alloys, however, provide a substantial lowering of the density of aluminum alloys (as well as a relatively high strength to weight ratio), which has been found to be very important in decreasing the overall structural weight of an aircraft. While substantial strides have been made in improving the aluminum-lithium processing technology, a major challenge is still to obtain a good blend of fracture toughness and high strength in an aluminum-lithium alloy.

SUMMARY OF THE INVENTION

The present invention provides a novel aluminum alloy composition that can be worked and heat treated so as to provide an aluminum-lithium alloy with high strength, good fracture toughness, and relatively low density compared to conventional 2000 Series aluminum alloys that it is intended to replace. An alloy prepared in accordance with the present invention has a nominal composition on the order of 2.5 weight percent lithium, 0.6 percent magnesium, 1.8 percent copper, and 0.12 percent zirconium. By underaging the alloy at a low temperature, an improvement in the excellent blend of fracture toughness and high strength results.

DETAILED DESCRIPTION OF THE INVENTION

An aluminum-lithium alloy formulated in accordance with the present invention can contain from about 2.2 to about 2.8 percent lithium, 0.3 to 0.9 percent magnesium, 1.55 to 2.1 percent copper, and a maximum of 0.15 percent zirconium as a grain refiner. Preferably from about 0.08 to about 0.15 percent, and most preferably 0.1 to 0.14 percent, zirconium is incorporated. All percentages herein are by weight percent based on the total weight of the alloy unless otherwise indicated. The magnesium in the alloy functions to increase the strength and toughness combination and to slightly decrease density. The preferred range of magnesium is from about 0.4 to about 0.8 percent. The copper also improves the blend of strength and toughness of the present alloy. Zirconium functions as a preferred grain refiner.

Iron and silicon can each be present in maximums up to 0.15 percent. The iron should be preferably no more than 0.12 percent, and most preferably less than 0.10 percent. The silicon is preferably limited to a maximum of 0.12 percent, and most preferably to less than 0.10 percent. Certain trace elements such as zinc, may be present in the amounts up to, but not to exceed, 0.25 percent of the total. Other elements such as chromium and manganese must be held to levels of 0.05 percent or below. If the maximums of these trace elements are exceeded, the desired properties of the aluminum-lithium alloy will tend to deteriorate. The trace elements sodium and hydrogen are also thought to be harmful to the properties (fracture toughness in particular) of aluminum-lithium alloys and should be held to the lowest levels practically attainable, for example on the order of 15 to 30 ppm (0.0015–0.0030 wt.%) for the sodium and less than 15 ppm (0.0015 wt.%) and preferably less than 1.0 ppm (0.0001 wt.%) for the hydrogen. The balance of the alloy, of course, comprises aluminum.

An aluminum-lithium alloy formulated in the proportions set forth in the foregoing paragraph is processed into an article utilizing known techniques. The alloy is formulated in molten form and cast into an ingot. The ingot is then homogenized at temperatures ranging from 925° F. to 1000° F. Thereafter, the alloy is converted into a usable article by conventional mechanical deformation techniques such as rolling, extrusion or the like. Once an article is formed, the alloy is normally subjected to a solution treatment at temperatures ranging from 950° F. to 1010° F., and quenched in a quenching medium such as water that is maintained at a temperature on the order of 70° F. If the alloy has been rolled or extruded, it is generally stretched on the order of 1 to 3 percent of its original length to relieve internal stresses.

The alumium alloy can then be further worked and formed into the various shapes for its final application. Additional heat treatments such as solution heat treatment can be employed if desired. For example, an êxtruded product after being cut to desired length is generally solution heat treated at temperatures on the order of 990° F. to 1010° F. for 1 to 4 hours. The product is then quenched in a quenching medium at temperatures on the order of 70° F.

Thereafter, in accordance with the present invention, the article is preferably subjected to an aging treatment that will increase the strength of the material, while maintaining its fracture toughness and other engineering properties at relatively high levels. In accordance with the present invention, the articles are subjected to a low temperature underage heat treatment at temperatures ranging from about 200° F. to about 300° F. when moderately high strength in conjunction with high toughness is desired. It is preferred that the alloy be aged in the range of from about 250° F. to 275° F. To achieve high strength in combination with moderate toughness the alloy is aged at a higher temperature in the range of 300° to 350° F. At the higher temperatures, less time is needed to attain the desired strength levels than at lower aging temperatures, but the overall property mix of strength and toughness will be slightly less desireable. For example, when the aging is conducted at temperatures on the order of 250° F. to 300° F., it is preferred that the product be subjected to the aging temperature for periods of from 2 to 80 hours. On the other hand, when aging is conducted at temperatures on the order of 325° F. or higher, aging times from 1 to 50 hours or more are preferred to bring about the proper balance between fracture toughness and high strength. After the aging treatment, the aluminum-lithium articles are cooled to room temperature.

When the low temperature underaging treatment is conducted in accordance with the parameters set forth above, the treatment will result in an aluminum-lithium alloy having a tensile yield strength on the order of 55 to 75 ksi. The fracture toughness of this alloy, however, will be on the order of 1½ to 2 times greater than that of similar aluminum-lithium alloys subjected to conventional aging treatments, which are normally conducted at temperatures greater than 300° F. The superior strength and toughness combination achieved by the low temperature underaging techniques in accordance with the present invention also surprisingly causes these aluminum-lithium alloys to exhibit an improvement in corrosion resistance when contrasted with the same alloys aged with standard aging practices. Examples of these improved characteristics will be set forth in more detail in conjunction with the ensuing example.

EXAMPLE

The following example is presented to illustrate the superior characteristics of an aluminum-lithium alloy aged in accordance with the present invention and to assist one of ordinary skill in making and using the present invention. Moreover, it is intended to illustrate the significantly improved and unexpected characteristics of an aluminum-lithium alloy formulated and manufactured in accordance with the parameters of the present invention. The following example is not intended in any way to otherwise limit the scope of this disclosure or the protection granted by Letters Patent hereon.

An aluminum alloy containing 2.4 percent lithium, 0.8 percent magnesium, 1.8 percent copper, 0.10 percent zirconium with the balance being aluminum was formulated. The trace elements present in the formulation constituted less than about 0.25 percent of the total. The iron and silicon present in the formulation constituted less than 0.07 percent each of the formulation. The alloy was cast and homogenized at about 995° F. Thereafter, the alloy was extruded into a flat bar product 0.75 inch by 2.5 inch in cross section. The resulting extrusion was then solution treated at about 1010° F. for about 95 minutes. It was then quenched in water maintained at about 70° F. Thereafter, the extrusion was subjected to a stretch of $2\pm\frac{1}{2}$ percent of its initial length and then cut into specimens. Specimens were cut to a size of 0.5 inch by 2½ inch by 0.5 inch for precrack Charpy impact tests, one method of measuring fracture toughness. Other specimens prepared for tensile strength tests were standard round specimens having a gage section diameter of 0.25 inches. Pluralities of specimens were then aged for 20 hours at 275° F. and for 48 hours at 325° F. Specimens aged at each of the temperatures and times were then subjected to tensile strength and precrack Charpy impact tests in accordance with standard testing procedures.

The specimens aged at 275° F. for 20 hours developed an average tensile yield strength of about 60 ksi, an average ultimate strength of 70.5 ksi, an average elongation of about 6%, with a toughness on the order of 1,125 in-lbs/in$^2$. The specimens aged at 325° F. for 48 hours exhibited an average tensile yield strength of 72.7 ksi, an average ultimate strength of 80.8 ksi, an average elongation of 6.0 percent, with an average toughness of about 365 in-lbs/in$^2$. These values are superior to the toughness values obtained for similar materials having similar yield strengths. Moreover, at intermediate strength levels the fracture toughness properties of the present alloy can be substantially enhanced by aging the alloy at temperatures below 300° F.

The present invention has been described in relation to various embodiments, including the preferred formulation and processing parameters. One of ordinary skill after reading the foregoing specification will be able to effect various changes, substitutions of equivalents, and other alterations without departing from the broad concepts set forth herein. It is therefore intended that the scope of the Letters Patent granter hereon will be limited only by the definition contained in the appended claims and equivalents thereof.

The embodiments of the invention in which an exclusive property or privilege is claimed are defined as follows:

1. An aluminum-lithium alloy exhibiting good fracture toughness consisting essentially of

| Element | Amount (wt. %) |
|---|---|
| Li | 2.2 to 2.8 |
| Mg | 0.3 to 0.9 |
| Cu | 1.55 to 2.1 |
| Zr | 0.08 to 0.15 |
| Fe | 0.15 max |
| Si | 0.12 max |
| Other trace elements | 0.25 max |
| Al | Balance. |

2. The alloy of claim 1 wherein said zirconium is present in amounts from about 0.10 to about 0.14 percent.

3. The alloy of claim 1 wherein said magnesium is present in amounts from about 0.4 to about 0.8 percent.

4. The alloy of claim 1 having a nominal composition of 2.5 percent lithium, 0.6 percent magnesium, 1.8 percent copper, and 0.12 percent zirconium.

5. The alloy of claim 1 wherein said alloy has been aged at a relatively low temperature for a relatively long time.

6. The alloy of claim 1 wherein said alloy has been aged at a temperature in the range of from 200° F. to 300° F.

7. The alloy of claim 6 wherein said alloy has been aged for a period of at least one hour.

8. The alloy of claim 1 wherein said alloy has been aged at a temperature of less than 275° F.

9. The alloy of claim 8 wherein said alloy has been aged for at least two hours.

10. The alloy of claim 1 wherein said alloy has been aged at a temperature of 250° F. to 275° F.

11. The alloy of claim 10 wherein said alloy has been aged for at least four hours.

* * * * *

UNITED STATES PATENT AND TRADEMARK OFFICE

CERTIFICATE OF CORRECTION

PATENT NO. : 4,603,029

DATED : July 29, 1986

INVENTOR(S) : Quist et al.

It is certified that error appears in the above-identified patent and that said Letters Patent is hereby corrected as shown below:

Column 2, line 42, "elements" should be --elements,--
Column 3, line 31, "desireable" should be --desirable--

Signed and Sealed this

Twenty-fifth Day of November, 1986

*Attest:*

DONALD J. QUIGG

*Attesting Officer* *Commissioner of Patents and Trademarks*